United States Patent [19]

Clements

[11] Patent Number: 4,589,569

[45] Date of Patent: May 20, 1986

[54] LID FOR DRINKING CUP

[75] Inventor: Jack D. Clements, Ada, Okla.

[73] Assignee: Solo Cup Company, Highland Park, Ill.

[21] Appl. No.: 643,667

[22] Filed: Aug. 22, 1984

Related U.S. Application Data

[63] Continuation-in-part of Ser. No. 545,076, Oct. 24, 1983, abandoned.

[51] Int. Cl.[4] ..... B65D 41/26; B65D 43/03; B65D 47/06

[52] U.S. Cl. ..... 220/380; 206/508; 220/90.2; 220/90.4; 229/7 R

[58] Field of Search ..... 220/90.2, 90.4, 254, 220/280; 229/7 R; 206/508

[56] References Cited

U.S. PATENT DOCUMENTS

| | | | |
|---|---|---|---|
| 110,148 | 12/1870 | Leach . | |
| 1,756,249 | 4/1930 | Kaufman . | |
| 2,003,657 | 6/1935 | Stubblefield . | |
| 2,414,697 | 1/1947 | Pettersson . | |
| 2,534,614 | 12/1950 | Michael | 220/90.4 |
| 2,731,751 | 1/1956 | Green . | |
| 2,765,639 | 10/1956 | Bryant | 220/90.4 |
| 3,225,915 | 12/1965 | Wise . | |
| 3,372,832 | 3/1968 | Yeater et al. . | |
| 3,373,896 | 3/1968 | Davis | 206/508 X |
| 3,486,665 | 12/1969 | Croce . | |
| 3,516,571 | 6/1970 | Roper et al. | 206/508 X |
| 3,557,995 | 11/1971 | Mirasol, Jr. . | |
| 3,800,999 | 4/1974 | Serritella . | |
| 3,868,043 | 2/1975 | Freemyer | 220/90.4 |
| 3,871,552 | 3/1975 | Irland et al. . | |
| 3,912,118 | 10/1975 | Bird . | |
| 3,915,331 | 10/1975 | Chenault | 220/90.4 |
| 3,915,355 | 10/1975 | Young . | |
| 3,931,890 | 1/1976 | Davis | 220/380 X |
| 3,938,690 | 2/1976 | Butler . | |
| 3,938,693 | 2/1976 | Patel et al. . | |
| 3,938,695 | 2/1976 | Ruff | 220/90.4 |
| 3,945,528 | 3/1976 | Mowrey, Jr. . | |
| 3,952,910 | 4/1976 | Wheeler . | |
| 3,958,717 | 5/1976 | Ellis . | |
| 3,977,559 | 8/1976 | Lombardi . | |
| 3,981,401 | 9/1976 | Blanchard | 220/380 X |
| 4,014,459 | 3/1977 | Robinson | 220/380 |
| 4,085,861 | 4/1978 | Ruff . | |
| 4,090,660 | 5/1978 | Schram et al. . | |
| 4,094,433 | 6/1978 | Numbers . | |
| 4,141,462 | 2/1979 | Rucci | 220/254 |
| 4,183,443 | 1/1980 | DeParales et al. . | |
| 4,184,604 | 1/1980 | Ambers et al. | 220/90.4 X |
| 4,187,954 | 2/1980 | Strissow | 220/90.4 |
| 4,212,408 | 7/1980 | Valenzona . | |
| 4,243,156 | 1/1981 | Lobbestael | 220/90.4 X |
| 4,303,170 | 12/1981 | Panicci | 220/90.4 X |
| 4,319,691 | 3/1982 | Hament . | |
| 4,322,015 | 3/1982 | Bailey . | |
| 4,345,695 | 8/1982 | Galloway et al. . | |
| 4,350,260 | 9/1982 | Prueher | 229/7 R |
| 4,361,249 | 11/1982 | Tuneski et al. . | |
| 4,441,624 | 4/1984 | Sokolowski | 220/90.4 X |

*Primary Examiner*—Allan N. Shoap

*Attorney, Agent, or Firm*—Fitch, Even, Tabin & Flannery

[57] ABSTRACT

A lid for a drinking cup includes an annular mounting portion for engaging the lip of the cup, an annular side wall extending upwardly from the mounting portion, and a top wall having a drinking opening formed in it. In the preferred embodiment, the top wall of the lid has a recess formed in it adjacent the drinking opening to accommodate the upper lid of the user.

6 Claims, 4 Drawing Figures

FIG. 1
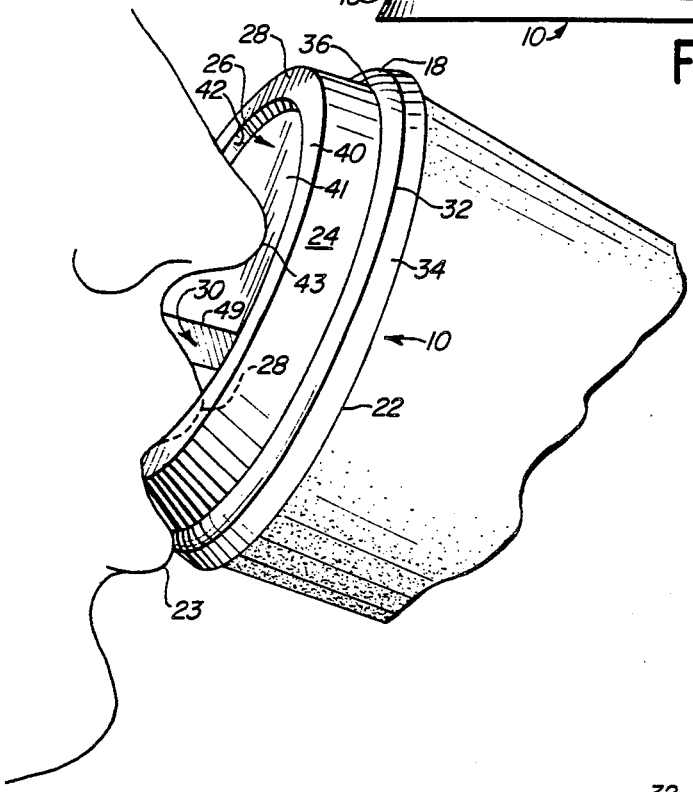
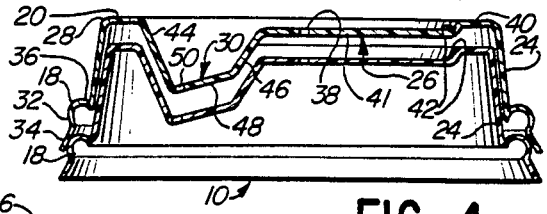
FIG. 4
FIG. 3
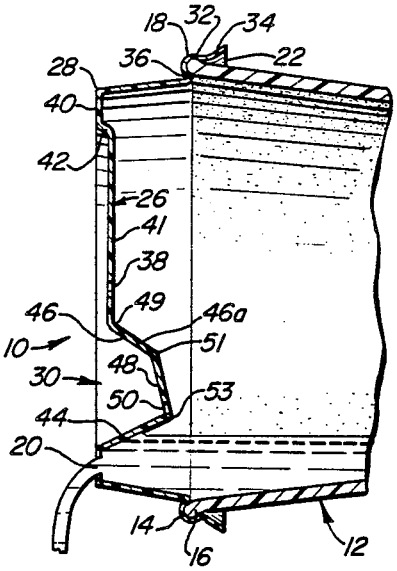
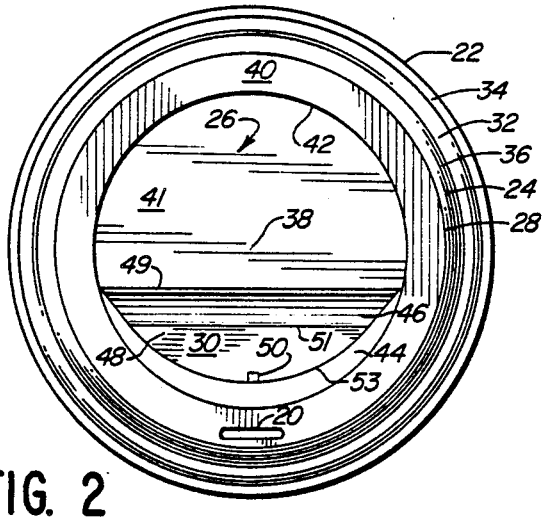
FIG. 2

LID FOR DRINKING CUP

This application is a continuation-in-part of copending application Ser. No. 545,076, filed Oct. 24, 1983 now abandoned

BACKGROUND OF THE INVENTION

The present invention relates generally to a lid for use in combination with a drinking cup and more particularly to a lid enabling drinking from the cup without removal of the lid.

It is well known to apply disposable lids to disposable drinking cups for carry-out sale of beverages such as coffee. Many of the lids commonly in use for this purpose must be removed prior to drinking of the beverage to provide access to the beverage. Removal of the lid may be inconvenient, particularly if the user is attempting to hold the cup and remove the lid with one hand. Also, if the user desires to drink the beverage while walking or traveling in a vehicle, removal of the lid may enable the beverage to splash out of the cup should the cup be jarred, or pour out of the cup should the cup be tilted.

Some lids have had score lines or the like formed in them to define a removable portion which may be punched out or folded to provide access to the beverage. One disadvantage of this type of lid is that it may be inconvenient for the user to perform the requisite penetration or folding of the lid, particularly if the user is walking or riding in a vehicle, or has only one hand free.

Some lids have included preformed openings for drinking. However, in some such lids which have been proposed in the past, the position of the opening has been such that drinking through the opening is difficult or uncomfortable due to the way in which the user's mouth engages the lid.

SUMMARY OF THE INVENTION

In accordance with the present invention, a lid is provided which is configured to facilitate drinking from the cup through an opening in the lid without spillage and without causing discomfort to the user. The preferred lid includes a mounting portion for gripping the upper rim of the cup, a side wall extending upwardly from the mounting portion, and a top wall having an opening formed therethrough. When drinking from the cup, the mouth of the user may seal against the lid adjacent the opening to prevent spillage. A recess is preferably provided adjacent the opening to accommodate the upper lip of the user. The side wall provides a relatively smooth surface for the lower lip of the user to engage, and enables drinking without the lower lip of the user contacting the lower edge of the lid. A vent opening may be formed in the top wall to enable air flow into the cup to facilitate the flow of liquid through the drinking opening. A drain opening may be formed at the bottom of the recess to enable liquid to drain from the recess into the cup.

Accordingly, it is a general object of the present invention to provide a lid for a drinking cup which enables a user to drink from the cup through an opening in the lid comfortably and without spillage.

A more specific object of the present invention is to provide a lid having an opening formed therethrough to enable drinking, and having a recess formed in the lid adjacent the opening to accommodate the upper lip of one drinking from the cup.

It is an additional object of the present invention to provide a relatively inexpensive drinking cup lid for carry-out beverages.

It is an additional object of the present invention to provide a lid for a drinking cup which is configured so that a plurality of lids may be stacked for compact storage prior to use.

Further object and features of the present invention will become apparent from the following description and the accompanying drawings.

BRIEF DESCRIPTION OF THE DRAWINGS

FIG. 1 is a perspective view of a lid in accordance with the present invention, shown in installed position on a cup and illustrating the engagement of the mouth of a user with the lid.

FIG. 2 is a plan view of the lid of FIG. 1.

FIG. 3 is a fragmentary sectional view of the lid and cup of FIG. 1.

FIG. 4 is a sectional elevational view of the lid of FIG. 1, shown in stacked relation with a second lid.

DETAILED DESCRIPTION OF THE PREFERRED EMBODIMENT

The present invention is generally embodied in a lid 10 for a drinking cup 12. For convenience of description, terms such as "upward", "downward", "horizontal", etc., are used herein, referring to the lid in an orientation as illustrated in FIG. 4. It will be understood that during use the lid 10 normally assumes various different orientations. The lid 10 may be used with cups of various types, and is particularly suitable for use with disposable cups of the type commonly used as carry-out containers for beverages such as coffee and the like. Such cups are commonly made of Styrofoam or paper. As illustrated in FIG. 3, the illustrated cup 12 has a generally circular upper lip or rim 14 (FIG. 3) with a bead 16 formed on it.

The lid 10 provides a cover for the cup 12 which inhibits spillage and reduces heat transfer between the beverage and the surrounding atmosphere, and is secured in place on the cup 12 by an annular mounting portion 18 which engages the rim or lip 14 of the cup. In the preferred embodiment, a preformed opening 20 is provided to enable drinking from the cup 12 without removal of the lid 10. In accordance with another embodiment of the present invention (not illustrated), the lid 10 might have score lines formed in it defining a removable portion to enable a drinking opening to be formed by the user.

In accordance with one feature of the present invention, the drinking opening 20 is positioned so that one may drink from the opening 20 without contacting the bottom edge 22 of the lid 10 with his lower lip 23, which might be uncomfortable. To this end, the lid 10 includes an annular side wall 24 extending upwardly from the mounting portion 18 and a top wall 26 extending across the top of the lid 10 and having a generally circular periphery 28 adjoining the side wall 24, and the drinking opening 20 is adjacent the periphery 28 of the top wall 26. In the illustrated embodiment, the opening 20 is formed through the top wall 26. In accordance with another embodiment (not shown), the opening might be formed in the side wall 24 just below the periphery 28 of the top wall 26.

In accordance with another feature of the present invention, a recess 30 is formed in the top wall 26 adjacent the drinking opening 20 to accommodate the upper lip 28 of the user. This enables one drinking from the cup to seal his mouth against the lid 10 about the drinking opening 20 to facilitate drinking while walking or traveling in a moving vehicle without spillage.

Turning now to a more detailed description of the present invention, the mounting portion 18 includes a resilient annular gripping portion 32 configured to grip the bead 16 on the lip 14 of the cup 12 and seal thereagainst. To facilitate mounting of the lid 10 on the cup 12 and movement of the gripping portion 32 into gripping engagement with the bead 16, the mounting portion 18 further includes an outwardly flared skirt 34 depending from the gripping portion 32. As the lid 10 is pushed downwardly onto the lip 14 of the cup 12, the skirt 34 aids in centering the lid and in deflecting the gripping portion 32 to an open position to enable it to fit over the bead 16. An annular channel 36 is defined at the juncture of the gripping portion 32 and the bottom of the side wall 24 which enables a small amount of liquid to be retained should such liquid drip down the side wall 24.

To enable the drinking opening 20 to be spaced from the lower edge 22 of the lid 10 by a distance sufficient to enable one to drink through the opening 20 without contacting the lower edge 22 of the lid 10 with his lower lip 23, the side wall 24 extends upwardly from the mounting portion 18 for about 0.5 in. or more. The spacing of the opening 20 from the mounting portion 22 also serves to inhibit accidental splashing of liquid upward through the opening 20, and enables portions of the lid 10 contacted by the user's mouth to remain relatively cool when a hot beverage is contained in the cup. In the illustrated embodiment, the height of the side wall is slightly over 0.5 in. This height provides the advantages described above without requiring the material costs associated with production of the lid to be unacceptably high, and without making the lid so bulky as to be unattractive or inconvenient to handle and store. The side wall 24 is preferably frusto-conical in shape, sloping upward and radially inward from the mounting portion to the top wall 26.

A vent hole 38 is formed near the center of the top wall 26 to enable air to flow into the cup 12 as the user drinks from the cup 12 to facilitate the flow of liquid out of the cup 12 through the drinking opening 20. A flat surface or rim 40 extends about the periphery of the top wall 26 to define a retaining wall 42. Located radially inwardly of the rim 40, and bordered by the rim 40 and the recess 30, is a generally flat portion 41 of the top wall 26 which is generally semicircular in shape. The vent hole 38 in the illustrated embodiment is located in the flat portion 41. The flat portion 41 is preferably capable of supporting a cup 12 so that a plurality of cups having lids 10 thereon may be stacked on top of one another. To this end, the inner diameter of the rim 40 is slightly larger than the bottom diameter of the cup 12, and the flat portion covers more than half of the area enclosed by the rim 40. The retaining wall 42 aids in constraining the bottom of the cup 12 against lateral movement. The retaining wall 42 additionally functions to retain liquid which may seep onto the flat portion 41 through the vent hole 38 to prevent such liquid from dripping down the side wall 24.

The flat portion 41 has a generally D-shaped periphery including an arcuate portion defined by the retaining wall 42 and a linear portion defined by the recess 30. The arcuate portion preferably defines an arc of greater than 180° so that the flat portion 41 may stably support a cup 12 having a bottom diameter slightly smaller than the inner diameter of the rim 40.

In the illustrated embodiment, the drinking opening 20 is formed in the rim 40. This leaves the flat portion 41 slightly lower than the opening 40, which may decrease interference between the nose 43 of the user and the top wall 26 during drinking, as illustrated in FIG. 1.

To inhibit accidental splashing or spilling of liquid through the drinking opening 20, the drinking opening 20 is relatively small. Herein, the drinking opening 20 is approximately ⅜ in. long and 3/16 in. wide and is oblong in shape with rounded ends 42.

As noted above, as an alternative to the drinking opening 20, the lid 10 might have score lines formed in it defining a movable portion which a user could penetrate or fold to gain access to the interior of the cup 12. The preformed opening is preferred, however, because it enables one to drink from the cup 12 without having to penetrate or fold any portion of the lid.

The recess 30 to accommodate the upper lip 28 of the user is formed adjacent the drinking opening 20 and radially inwardly thereof. In addition to accommodating the upper lip 28 of one drinking from the cup, the recess 30 may also inhibit splashing of the liquid up through the drinking opening 20.

In the illustrated embodiment, the recess 30 is defined by a curved wall 44 which extends generally downward and slightly radially inward from the rim 40, and a pair of contiguous, generally planar inclined surfaces 46 and 48 intersecting the curved wall 44. A drain opening 50 is formed at the bottom of the recess 30 so that any liquid which runs into the recess 30 from the drinking opening 10 or the vent opening 38 may drain back into the cup 12. The recess 30 preferably has a depth slightly less than the height of the side wall 24. This enables the lid 10 to be placed on a full cup 12 without the lowermost portion of the top wall 26 extending into the liquid in the cup 12.

Referring particularly to FIGS. 2 and 3, the first inclined surface 46 intersects the flat portion 41 of the top wall 26 along line 49 and slopes downward therefrom. The second surface 48 intersects the first surface 46 along line 51 and slopes downward from line 51 toward the drain opening 50, intersecting the curved wall 44 along curve 53. The inclined surfaces 46 and 48 define between them an obtuse dihedral included angle.

The configuration of the recess 30 as described above enables it to accommodate the upper lip of one drinking from the cup 12 without presenting unacceptable difficulties in molding the lid. The slope of the first inclined surface 46 is such that the corresponding portion **46*a* of the underside of the top wall 26 does not tend to collect liquid when the cup 12 is tilted as illustrated in FIG. 3. Another advantage of the configuration of the recess 30 described above is that it does not interfere with stacking of the lids 10** in nested relation.

The lid 10 is preferably of one piece plastic construction, which enables the lid 10 to be manufactured relatively inexpensively so as to be disposable. The illustrated lid may be manufactured by a thermoforming operation, preferably vacuum forming.

The configuration of the illustrated lid was selected not only to provide the above features, but also to enable manufacture of the lid by vacuum forming. To this end, the upper inclined surface 46 is inclined at an angle of approximately 45° with respect to the plane defined by the flat portion 41 of the top wall 26. If this surface were inclined too steeply, vacuum forming might stretch the material too thin at some portions of the upper inclined surface 46.

After the vacuum forming operation has been completed, the openings 20, 38 and 50 may be formed in the lid. The drinking opening 20 is preferably formed with a punch and die. The drain opening 50 and vent opening 38, which are preferably smaller than the drinking opening 20, may be formed simply by puncturing the top wall 26 of the lid 10 with a pointed tool.

The thickness of the material of the lid 10 is selected to provide satisfactory strength while enabling enough flexibility to facilitate gripping engagement of the lip of the cup by the gripping portion of the lid. Also, as noted above, the lid requires a relatively small amount of material, which enables it to be produced economically.

From the foregoing, it will be appreciated that the present invention provides a novel and improved lid 10 for a drinking cup 12. The lid 10 is configured so that a plurality of lids 10 may be stacked in nested relation, as illustrated in FIG. 4, which facilitates storage and use of the lids 10. When a plurality of lids 10 are placed in stacked relation, the mounting portion 18 of each lid 10 rests upon the mounting portion 18 of the lid 10 below it. To prevent the lids 10 from binding together when in stacked relation, the side walls of the respective lids do not contact one another, and the mounting portions are configured so that downward pressure on a stack of lids 10 does not cause the mounting portion 18 of a lid 10 to grip the mounting portion 18 of the lid 10 beneath it.

As best seen in FIG. 3, placement of the drinking opening 20 adjacent the periphery 28 of the top wall 26 enables liquid to be poured from the cup through the drinking opening 20, if desired, so that the cup 12 may be substantially emptied through the drinking opening 20 relatively easily.

The lid 10 described above is particularly suitable for use at a carry-out counter in a restaurant where efficiency is important. An employee can fill a cup 12 with coffee or the like and apply the lid 10 quickly and simply by snapping it onto the cup 12. A consumer may then pick up the cup 12 with one hand and drink from it while walking or riding in a vehicle without removing or penetrating the lid 10.

While a preferred embodiment has been described above and illustrated in the accompanying drawings, there is no intent to limit the scope of the invention to this or any other particular embodiment.

What is claimed is:

1. A lid for a drinking cup, the lid comprising:

a top wall having a generally circular periphery;

an annular side wall depending from said top wall about its periphery; and an annular mounting portion at the bottom of said side wall for sealingly engaging the lip of the drinking cup;

said lid having a drinking opening therein adjacent said periphery to enable drinking from the cup without removal of the lid;

said top wall including a recessed portion for receiving the upper lip of a person drinking from the cup; and said recessed portion having a drain opening formed therethrough to permit liquid to drain from said recessed portion into said drinking cup; said drain opening being separate from said drinking opening.

2. In combination, a drinking cup having a generally circular rim with a bead formed thereon, and a lid cooperative with said drinking cup for mounting thereon, the lid comprising:

an annular mounting portion for gripping the bead to retain said lid on said cup;

an annular side wall extending upwardly from the mounting portion; and a top wall having a drinking opening formed through it;

the annular mounting portion comprising a resilient flexible annular gripping portion for gripping said bead and sealing thereagainst, and a depending skirt portion extending downwardly and radially outwardly from said gripping portion to facilitate mounting of said lid on said cup;

said side wall being generally frustoconical in shape and being sloped upward and radially inward from said mounting portion, said side wall further being of substantially uniform height about its periphery, and said skirt and said mounting portion being configured so that a plurality of said lids may be stacked in nested relation with the skirt portion of each lid above the bottom of the stack engaging the mounting portion of the lid beneath it without contact between the respective side walls of adjacent lids;

said mounting portion including a portion which slopes downwardly toward said side wall adjacent said side wall to define an annular groove adjacent the bottom of the exterior of said side wall;

said drinking opening being positioned about 0.5 inches above the rim of the cup when said lid is mounted on said cup;

said top wall including a recessed portion for accommodating the upper lip of one drinking from the cup; and said recessed portion including a curved wall sloping downwardly and radially inwardly adjacent said drinking opening, and a pair of contiguous generally planar inclined surfaces intersecting said curved wall, said surfaces each extending to opposing portions of said curved wall on each side of a diametric line passing through said drinking opening with one of said inclined surfaces being between the other of said inclined surfaces and said curved wall.

3. A thermoformed plastic lid for a drinking cup, the lid comprising:

a generally horizontal top wall having a generally circular periphery;

an annular side wall depending from said top wall about its periphery; and an annular mounting portion at the bottom of said side wall for sealingly engaging the lip of the drinking cup;

said top wall having a drinking opening formed therethrough adjacent said periphery, a recess formed therein radially inwardly of said drinking opening for receiving the upper lip of a person drinking from the cup, and a generally horizontal support surface oriented generally parallel to said annular mounting portion;

said recess being defined by a concave surface sloping downward and radially inward adjacent said drinking opening, a first generally planar surface intersecting said concave surface at an arcuate line of intersection and sloping generally upward therefrom, and a second generally planar surface intersecting said first generally planar surface and sloping upward therefrom.

4. A lid in accordance with claim 3 wherein said second generally planar surface intersects said generally horizontal support surface at an angle of about 135°.

5. A thermoformed plastic lid for a drinking cup, the lid comprising:

a generally horizontal top wall having a generally circular periphery;

an annular side wall depending from said top wall about its periphery; and an annular mounting portion at the bottom of said side wall for sealingly engaging the lip of the drinking cup;

said top wall having a drinking opening formed therethrough adjacent said periphery, a recess formed therein radially inwardly of said drinking opening for receiving the upper lip of a person drinking from the cup, a generally horizontal support surface oriented generally parallel to said annular mounting portion, and a substantially circular peripheral surface which is raised with respect to the generally horizontal support surface to define a retaining wall inwardly of said top wall; said generally horizontal support surface having a generally D-shaped periphery and being partially surrounded by said retaining wall, said retaining wall intersecting said generally horizontal support surface about the arcuate portion of said generally D-shaped periphery a portion of said recess intersecting the straight edge of said generally D-shaped periphery and an opposing portion of said recess being intersected by said retaining wall.

6. A lid in accordance with claim 5 wherein said arcuate portion of said generally D-shaped periphery defines an arc of greater than 180°.

* * * * *

UNITED STATES PATENT AND TRADEMARK OFFICE

CERTIFICATE OF CORRECTION

PATENT NO. : 4,589,569

DATED : May 20, 1986

INVENTOR(S) : Jack D. Clements

It is certified that error appears in the above-identified patent and that said Letters Patent is hereby corrected as shown below:

In the Abstract, line 7, change "lid" to --lip--.

Column 1, line 6, after "abandoned" insert --.--(period).

Column 8, line 10, after "periphery" insert --,--(comma).

Signed and Sealed this

Fourteenth Day of October, 1986

[SEAL]

*Attest:*

DONALD J. QUIGG

*Attesting Officer*

*Commissioner of Patents and Trademarks*